US009690244B2

(12) United States Patent
Abe et al.

(10) Patent No.: US 9,690,244 B2
(45) Date of Patent: Jun. 27, 2017

(54) IMAGE FORMING SYSTEM

(71) Applicant: CANON KABUSHIKI KAISHA, Tokyo (JP)

(72) Inventors: Hideto Abe, Toride (JP); Yusuke Obuchi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/834,990

(22) Filed: Aug. 25, 2015

(65) Prior Publication Data

US 2015/0362880 A1 Dec. 17, 2015

Related U.S. Application Data

(62) Division of application No. 13/927,618, filed on Jun. 26, 2013.

(30) Foreign Application Priority Data

Jun. 29, 2012 (JP) ..... 2012-147792
Jun. 14, 2013 (JP) ..... 2013-125210

(51) Int. Cl.
*G03G 15/00* (2006.01)

(52) U.S. Cl.
CPC ..... *G03G 15/6538* (2013.01); *G03G 15/6541* (2013.01); *G03G 2215/0487* (2013.01)

(58) Field of Classification Search
CPC ..... B41F 2201/0789; G03G 15/6582; G03G 15/6541
USPC ..... 399/408, 410
See application file for complete search history.

(56) References Cited

U.S. PATENT DOCUMENTS 5,456,646 A * 10/1995 Crowley ..... B42D 15/08 156/277
5,531,429 A * 7/1996 Clark ..... B42C 9/0081 156/908
6,980,767 B1 12/2005 Cahill et al.
8,180,232 B2 5/2012 Lawniczak et al.
8,333,372 B2 12/2012 Awaya et al.
8,342,497 B2 1/2013 Abe
(Continued)

FOREIGN PATENT DOCUMENTS

JP 2008-176200 A 7/2008
JP 2010-189101 A 9/2010
(Continued)

OTHER PUBLICATIONS

Office Action dated Feb. 2, 2016, in Japanese Patent Application No. 2013-125210.
(Continued)

*Primary Examiner* — Anthony Nguyen
(74) *Attorney, Agent, or Firm* — Fitzpatrick, Cella, Harper & Scinto

(57) ABSTRACT

A toner image is formed on a sheet based on image data by an image forming portion, and a plurality of sheets on which the toner image is formed is bound together by a stapleless binding unit including a pair of tooth-like members, each having a concave and convex portion. Then, the image data is corrected by a correction portion so that a ratio of toner within a part of the sheet to be subjected to binding processing by the stapleless binding unit is equal to or smaller than a predetermined value.

31 Claims, 14 Drawing Sheets

(56) References Cited

U.S. PATENT DOCUMENTS

| | | | | |
|---|---|---|---|---|
| 8,408,531 | B2 * | 4/2013 | Sato | B65H 37/04 270/58.07 |
| 8,422,937 | B2 | 4/2013 | Kushida et al. | |
| 8,459,629 | B2 | 6/2013 | Abe | |
| 8,548,371 | B2 * | 10/2013 | Kwarta | G03G 15/6544 399/409 |
| 9,110,425 | B2 * | 8/2015 | Watanabe | B65H 37/04 |
| 2009/0035002 | A1 * | 2/2009 | Kushida | B42C 9/0081 399/53 |
| 2010/0202814 | A1 * | 8/2010 | Nakamura | B65H 37/04 399/408 |
| 2011/0222945 | A1 * | 9/2011 | Sato | B42C 1/12 399/408 |
| 2011/0299869 | A1 | 12/2011 | Tai et al. | |
| 2012/0034009 | A1 | 2/2012 | Sato | |
| 2012/0090441 | A1 | 4/2012 | Abe | |
| 2012/0155944 | A1 | 6/2012 | Matsue et al. | |
| 2013/0215470 | A1 * | 8/2013 | Ikuno | G06K 15/1867 358/1.18 |

FOREIGN PATENT DOCUMENTS

| | | | | |
|---|---|---|---|---|
| JP | 2011-011913 | A | | 1/2011 |
| JP | 2013043751 | A | * | 8/2011 |
| JP | 2011-201653 | A | | 10/2011 |

OTHER PUBLICATIONS

Office Action dated Sep. 6, 2016, in Japanese Application No. 2013-125210.

* cited by examiner

COVERAGE FACTOR 8%

COVERAGE FACTOR 45%

COVERAGE FACTOR 90%

CS-680
(FIVE SHEETS OF PLAIN PAPER)

| | COVERAGE FACTOR % | | | |
|---|---|---|---|---|
| | 0 | 8 | 45 | 90 |
| FIRST TIME | 7.50 | 7.50 | 1.36 | 1.75 |
| SECOND TIME | 7.02 | 6.20 | 0.50 | 0.44 |
| THIRD TIME | 7.98 | 7.00 | 2.48 | 0.30 |
| AVERAGE | 7.50 | 6.90 | 1.45 | 0.83 (N) |

GF-R070
(FIVE SHEETS OF RECYCLED PAPER)

| | COVERAGE FACTOR % | | | |
|---|---|---|---|---|
| | 0 | 8 | 45 | 90 |
| FIRST TIME | 5.12 | 4.68 | 2.90 | 1.21 |
| SECOND TIME | 6.05 | 6.05 | 3.24 | 1.79 |
| THIRD TIME | 5.63 | 4.70 | 1.87 | 1.37 |
| AVERAGE | 5.60 | 5.14 | 2.67 | 1.46 (N) |

IMAGE FORMING SYSTEM

This application is a division of U.S. patent application Ser. No. 13/927,618, filed on Jun. 26, 2013.

BACKGROUND OF THE INVENTION

Field of the Invention

The present invention relates to an image forming apparatus and an image forming system, and more particularly, to an image forming system for binding sheets already subjected to image formation together without using staples.

Description of the Related Art

Up to now, as an image forming apparatus, such as a copier, a laser beam printer, a facsimile machine, or a multifunction peripheral thereof and an image forming system including the image forming apparatus, there is an image forming system which includes a sheet processing apparatus for performing processing such as binding for sheets on which images are formed. In the image forming system, a sheet bundle is bound by the sheet processing apparatus generally by using metal staples. Staple processing using the staples allows multiple sheets of output paper to be reliably bound together in a position designated by a user, and is therefore employed by a large number of sheet processing apparatuses.

In the staple processing using the metal staples, the sheet bundle can be bound reliably, but when the sheet bundle that has been bound once is released, damage is highly likely to be done to the sheets even with special tools, and it is difficult to maintain quality of the sheets. The staples are consumables, and hence cost thereof is required.

In shredding the sheets subjected to the staple processing, the staples need to be removed, which requires time and labor. When recycling the sheet bundle bound by using the staples, it is necessary from the viewpoint of environmental issues to remove the staples and collect the sheets and the staples separately from each other, which also requires time and labor. The staples are disposed of after their use, resulting in waste of resources.

Among conventional sheet processing apparatus, there is proposed a sheet processing apparatus for binding sheets together without using staples by placing importance on recyclability in consideration of the environment and the like. As an example of the above-mentioned sheet processing apparatus, Japanese Patent Application Laid-Open No. 2010-189101 discloses a sheet processing apparatus for subjecting a sheet bundle to binding processing by using a binding portion provided with upper teeth and lower teeth each having a concave and convex portion.

In the above-mentioned sheet processing apparatus, after sheets are stacked and aligned, the lower teeth and the upper teeth of the binding portion are engaged with each other to form depth-direction asperities in a part of the sheet bundle, thereby fibers of the overlapping sheets of the sheet bundle are entangled with each other to bind the sheet bundle. In other words, according to the above-mentioned sheet processing apparatus, fibrous sheets are bound together without using staples. Such a binding method of binding a bundle of fibrous sheets without using staples is hereinafter referred to as "stapleless binding".

In cases of a conventional image forming apparatus and a conventional image forming system which include the sheet processing apparatus for binding the sheet bundle by entangling the fibers of the sheets with each other, the binding of the sheets is affected by toner images formed on the sheets. For example, in a case where the toner images are formed on surfaces of the sheets that are brought into contact with each other, sheet surfaces are covered with toner, and hence the fibers of the sheets are hard to be entangled with each other. In other words, depending on a ratio of the toner covering the sheet surface within a region in which binding is to be performed, the sheet bundle cannot be bound even by being depressed in a teeth shape because the fibers of the sheets fail to be entangled with each other.

The present invention has been made in view of the above-mentioned circumstances, and provides an image forming apparatus and an image forming system which are capable of reliably subjecting sheets to stapleless binding.

SUMMARY OF THE INVENTION

According to an exemplary embodiment of the present invention, there is provided an image forming system, including: an image forming portion which forms a toner image on a sheet based on image data; a sheet stacking portion on which a plurality of sheets, on which the toner image is formed, is stacked; a sheet conveying portion which conveys an image formed sheet to the sheet stacking portion; a binding portion which includes a pair of tooth-like members, each having a concave and convex portion, that are engageable with each other, and which binds the plurality of sheets stacked on the sheet stacking portion together by engaging the plurality of sheets between the pair of tooth-like members; and a correction portion which corrects the image data so that a ratio of a region of a sheet surface covered with toner within a region of the sheet to be subjected to binding processing by the binding portion is equal to or smaller than a predetermined value.

According to the exemplary embodiment of the present invention, it is possible to reliably subject the sheets to the stapleless binding by correcting the image data so that the ratio of the toner within the part of the sheet to be subjected to the binding processing by the binding portion is equal to or smaller than the predetermined value.

Further features of the present invention will become apparent from the following description of exemplary embodiments with reference to the attached drawings.

DESCRIPTION OF THE EMBODIMENTS

Figure 1:
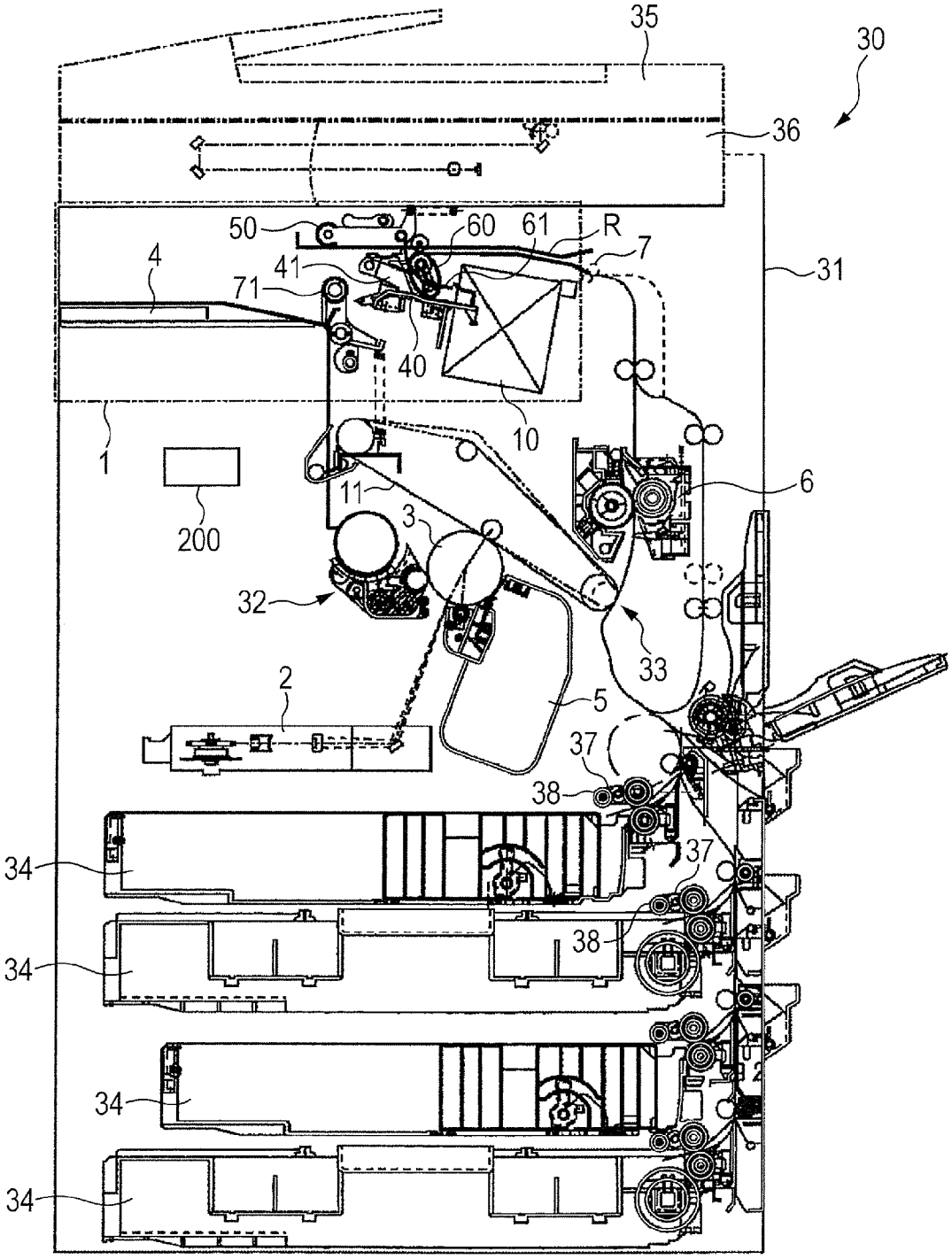
FIG. 1 illustrates a structure of a printer being an example of an image forming apparatus according to an embodiment of the present invention.

Now, embodiments for carrying out the present invention are described in detail with reference to the accompanying drawings. FIG. 1 illustrates a structure of a printer being an example of an image forming apparatus according to an embodiment of the present invention. In FIG. 1, an original reading apparatus (image reader) 36 is provided to an upper part of a printer main body 31 of a printer 30. The original reading apparatus 36 is provided with an original conveying apparatus 35 for automatically reading multiple originals.

The printer main body 31 includes sheet feeding cassettes 34 for stacking sheets on which images are to be formed, an image forming portion 32 for forming a toner image on the sheet by using an electrophotographic process, and a fixing portion 6 for fixing the toner image formed on the sheet. A finisher 1 being a sheet processing apparatus is connected between the printer main body 31 and the original reading apparatus 36. A CPU circuit portion 200 is a control portion for administrating control of the printer main body 31 and the finisher 1.

In the printer 30, in order to form an image of an original (not shown) on a sheet, the original reading apparatus 36 is first used to read the image of the original conveyed by the original conveying apparatus 35. After that, the read data is input to a laser scanner unit 2, and the laser scanner unit 2 irradiates a photosensitive drum 3 provided to the image forming portion 32 with laser light based on the data. When irradiated with the laser light, an electrostatic latent image is formed on a photosensitive drum surface. The electrostatic latent image is developed with toner including a thermoplastic resin such as polyester by a developing device 5, to thereby form the toner image on the photosensitive drum surface. The toner image is transferred onto the transfer belt 11.

The sheets are appropriately dispensed selectively from the sheet feeding cassette 34 by a pick-up roller 38 constituting a sheet feeding portion, and are separated and fed one by one by a separation portion 37. After that, skew feed of a sheet S is corrected by a pre-registration roller pair (not shown), and the sheet S is then sent to a transfer portion 33 in synchronization with rotation of the photosensitive drum 3. In the transfer portion 33, the toner image, which has been formed on the photosensitive drum 3 and then transferred onto the transfer belt 11, is transferred onto the sheet S.

Subsequently, the sheet is guided to the fixing portion 6, and heated and pressurized in the fixing portion 6. Thereby the transferred toner image is fixed thereto permanently. After that, the sheet having the toner image fixed thereto permanently is conveyed to an external portion of the printer main body 31 by a main body-side delivery roller pair 7, and is guided to the sheet processing apparatus 1.

The sheet processing apparatus 1 includes a processing tray 40 being a sheet stacking portion inclined downward on an upstream side in a sheet conveying direction, and a stack tray 4 that is substantially horizontal and disposed on a downstream side in the sheet conveying direction of the processing tray 40. Further, the sheet processing apparatus 1 includes a pivoting roller 50 for dropping a sheet trailing edge into the processing tray 40, the pivoting roller 50 being provided above the processing tray 40 so as to be free to pivot and being able to pivot in normal and reverse directions. In addition, the sheet processing apparatus 1 includes a stapleless binding unit 10 being a binding portion for performing stapleless binding as illustrated in FIGS. 2A and 2B.

Figure 2A:
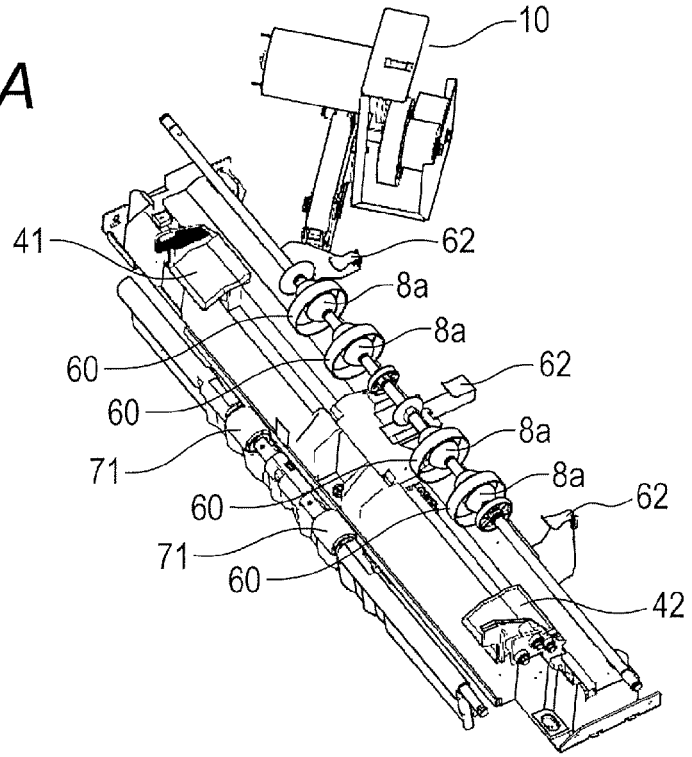
FIGS. 2A and 2B illustrate a finisher being a sheet processing apparatus provided to the above-mentioned printer.
Figure 2B:
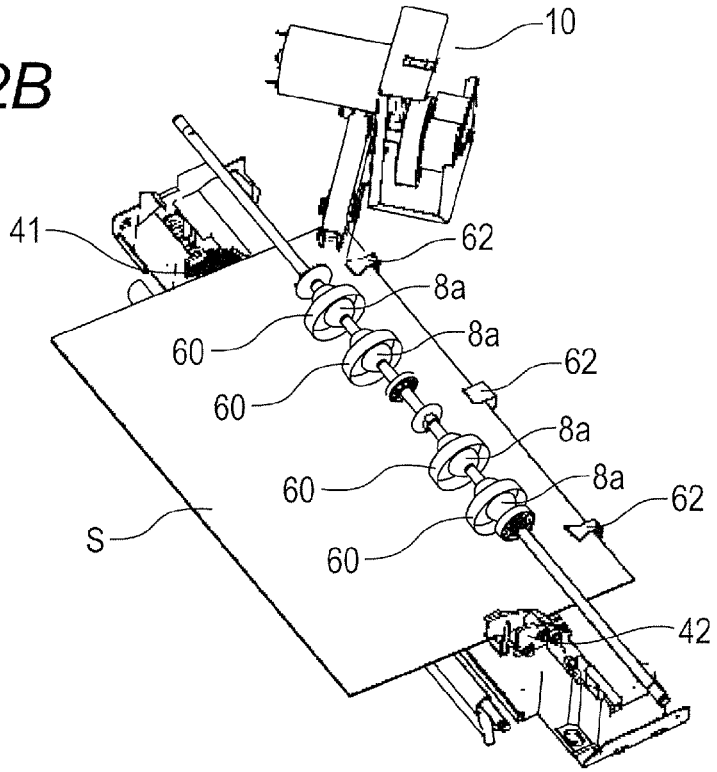

When the sheet already subjected to image formation is delivered from the printer main body 31, the sheet is delivered toward the stack tray 4 via a conveying route R by a delivery portion including delivery rollers 8*a* and a delivery rotatable member (not shown) of the sheet processing apparatus 1 illustrated in FIGS. 2A and 2B. Subsequently, the pivoting roller 50 pivots downward at a timing at which a trailing edge of the sheet passes through the delivery portion. With this structure, the sheet trailing edge is dropped by the pivoting roller 50, and is nipped between the pivoting roller 50 and a driven rotatable member 71 serving as a sheet conveying portion.

Subsequently, by counterclockwise rotation of the pivoting roller 50, the sheet is sent onto the processing tray 40 along a lower guide 61 in a direction reverse to the conveying direction followed so far. After that, by the inclination of the processing tray 40 and by reversing belts 60 illustrated in FIG. 2A, the sheet S abuts against trailing edge stoppers 62 being a sheet receiving portion located at an end portion of the processing tray 40, for receiving the sheet S on the processing tray 40. With this structure, the sheet S is aligned in the conveying direction. Subsequently, aligning plates 41 and 42 provided to the processing tray 40 are moved in a width direction orthogonal to the sheet conveying direction by a drive portion (not shown), to thereby align the sheet S in the width direction.

When the aligning of the sheet S in the conveying direction and the width direction is finished, in a case where a binding mode is selected, the stapleless binding unit 10 performs binding processing for multiple sheets S that have already been subjected to the aligning as illustrated in FIG. 2B. After that, the sheets S that have undergone the binding processing are delivered onto the stack tray 4 illustrated in FIG. 1 by clockwise rotation of the pivoting roller 50, and are stacked thereon.

Figure 3:
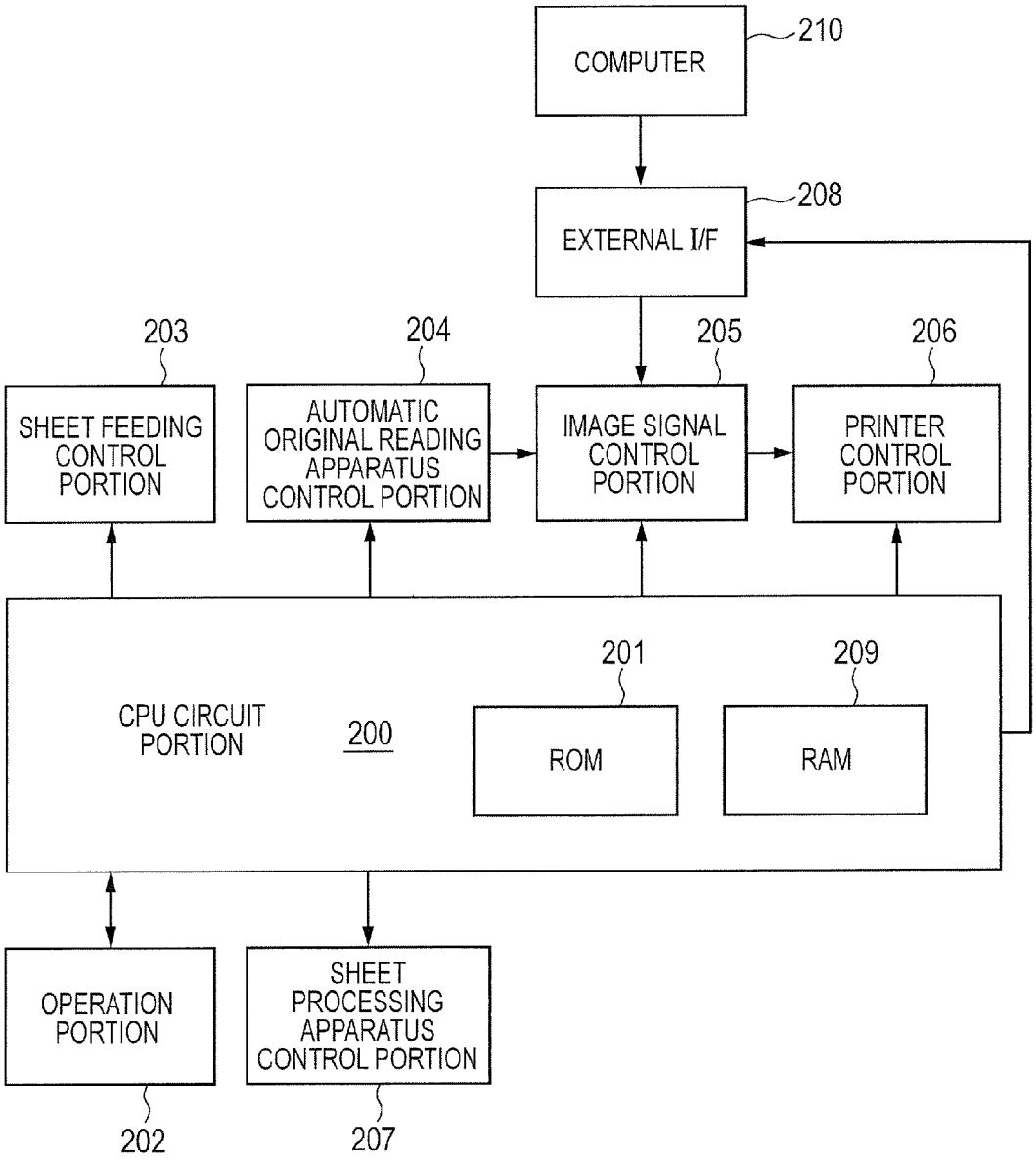
FIG. 3 is a control block diagram of a printer main body and the finisher of the above-mentioned printer.

FIG. 3 is a control block diagram of the printer main body 31 and the finisher 1. As illustrated in FIG. 3, the CPU circuit portion 200 includes a CPU (not shown), a ROM 201 for storing a control program, and a RAM 209 used as an area for temporarily storing control data or a work area for arithmetic operations involved in the control.

The CPU circuit portion 200 controls a sheet feeding control portion 203, an automatic original reading apparatus control portion 204, and an image signal control portion 205 according to the control program stored in the ROM 201 and settings of an operation portion 202 provided to, for example, an upper surface of the printer main body 31. The CPU circuit portion 200 controls a printer control portion 206 and a sheet processing apparatus control portion 207 according to the control program and the settings of the operation portion 202.

The sheet feeding control portion 203 controls the separation portion 37 and the pick-up rollers 38, and the automatic original reading apparatus control portion 204 controls the original conveying apparatus 35 and the original reading apparatus 36. The printer control portion 206 controls the laser scanner unit 2, the photosensitive drum 3, the developing device 5, the fixing portion 6, and the like, and the sheet processing apparatus control portion 207 controls the sheet processing apparatus 1.

The operation portion 202 includes multiple keys for setting various functions relating to the image formation and a displaying portion for displaying a setting state. Then, the operation portion 202 outputs a key signal corresponding to the user's operation of each key to the CPU circuit portion 200, and displays corresponding information based on a signal received from the CPU circuit portion 200 on the displaying portion.

An external I/F 208 is an interface between the printer main body 31 and an external computer 210, and decompresses print data received from the computer 210 into a bitmap image to output the bitmap image to the image signal control portion 205 as image data. The image of the original read by an image sensor (not shown) is output from the automatic original reading apparatus control portion 204 to the image signal control portion 205. The printer control portion 206 outputs the image data received from the image signal control portion 205 to an exposure control portion (not shown). In this embodiment, the sheet processing apparatus 1 is controlled by the sheet processing apparatus control portion 207, but the CPU circuit portion 200 may directly control the sheet processing apparatus 1.

Figure 4A:
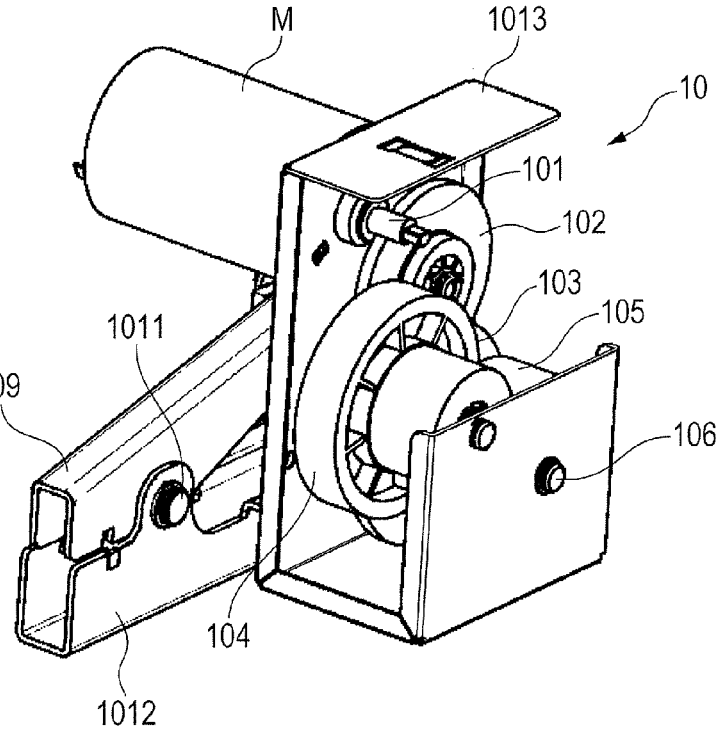
FIGS. 4A and 4B illustrate a structure of a stapleless binding unit provided to the above-mentioned finisher.
Figure 4B:
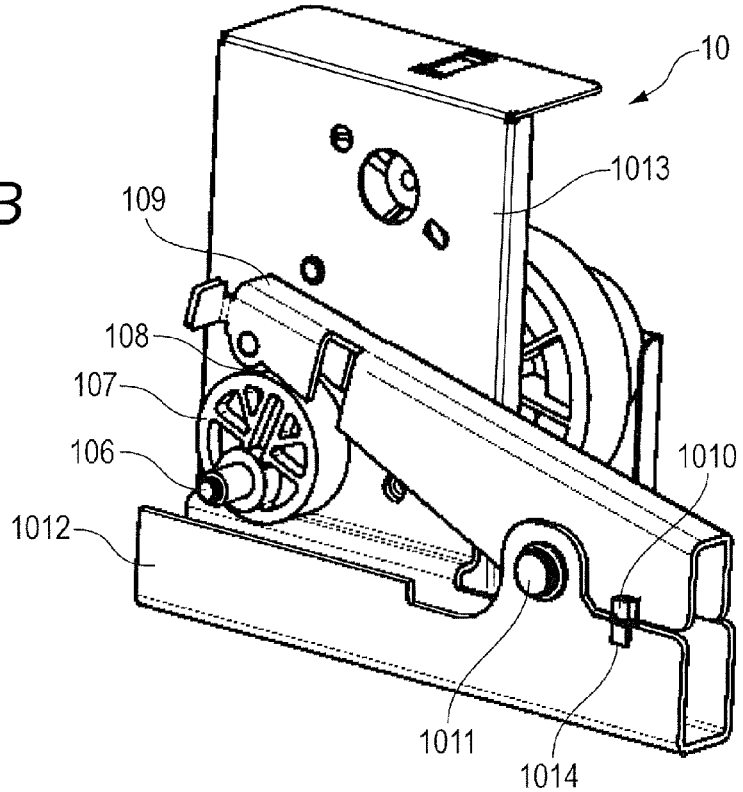

Referring to FIGS. 4A and 4B, the stapleless binding unit 10 is described. The stapleless binding unit 10 includes, as illustrated in FIG. 4A, a motor M, a gear 101 rotated by the motor M, step gears 102 to 104 rotated by the gear 101, and a gear 105 rotated by the step gears 102 to 104. The stapleless binding unit 10 includes a lower arm 1012 fixed to a frame 1013, and an upper arm 109 provided to the lower arm 1012 so as to be free to swing about a shaft 1011 and urged onto a lower arm side by an urging member (not shown).

The gear 105 is mounted to a rotation shaft 106. As illustrated in FIG. 4B, a cam 107 is mounted to the rotation shaft 106 and provided between the upper arm 109 and the lower arm 1012. With this structure, when the motor M is rotated, the rotation of the motor M is transmitted to the rotation shaft 106 via the gear 101, the step gears 102 to 104, and the gear 105, and causes the cam 107 to rotate.

Figure 5A:
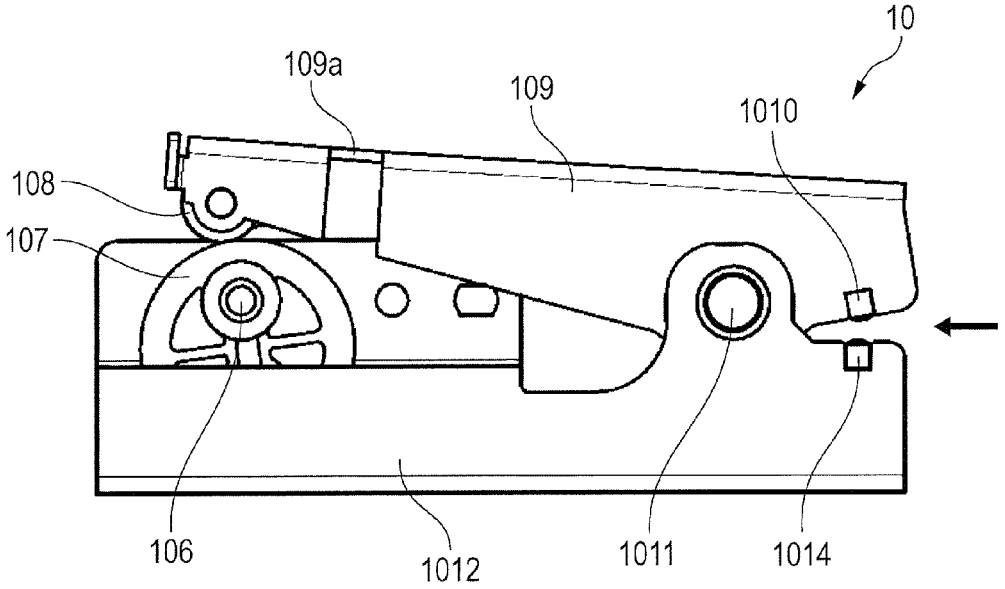
FIGS. 5A and 5B illustrate an operation of the above-mentioned stapleless binding unit.
Figure 5B:
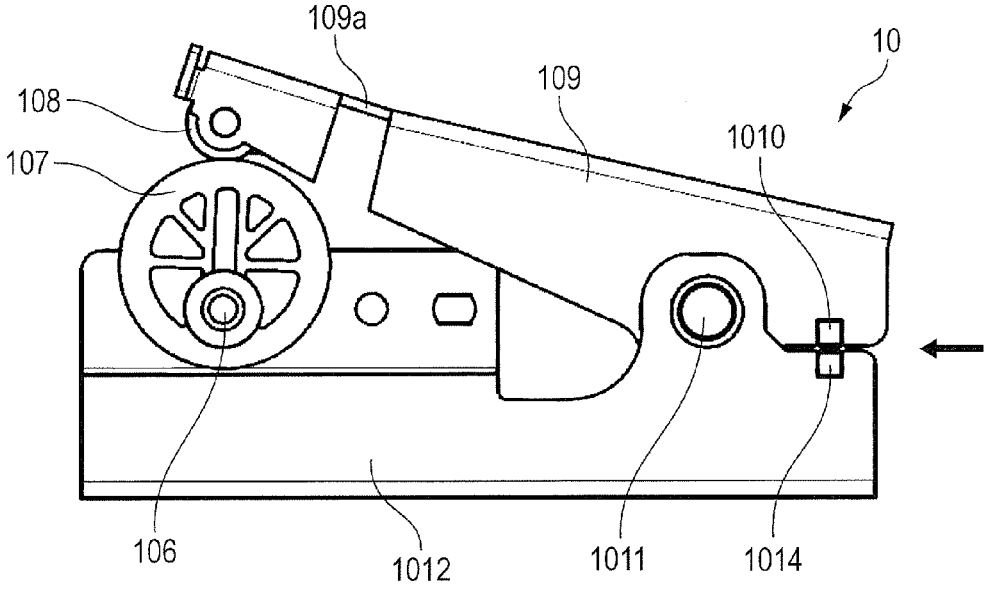
Figure 6:
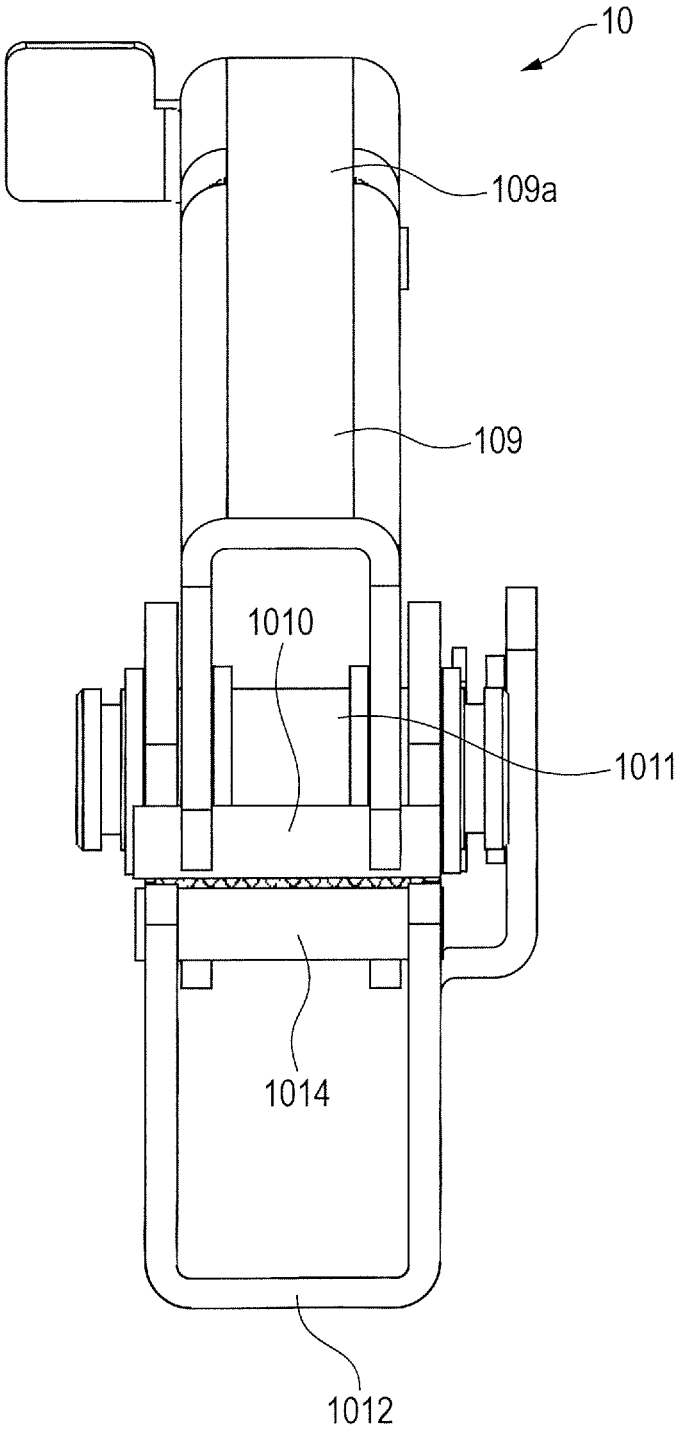
FIG. 6 is a side view of the above-mentioned stapleless binding unit.

When the cam 107 is rotated, a cam-side end portion of the upper arm 109, which is brought into press contact with the cam 107 by the urging member (not shown) via a rotatable member 108 as illustrated in FIG. 5A, rises as illustrated in FIG. 5B. Upper teeth 1010 are mounted on a lower edge of the end portion of the upper arm 109 opposite to the cam 107, and lower teeth 1014 are mounted on an upper edge of the end portion of the lower arm 1012 opposite to the cam 107. FIG. 6 illustrates the stapleless binding unit 10 when FIG. 5B is viewed from the arrow direction, and each of the lower teeth 1014 and the upper teeth 1010, serving as a pair of tooth-like members, has a concave and convex portion.

With this structure, when the cam-side end portion of the upper arm 109 rises, the end portion of the upper arm 109 opposite to the cam 107 drops, and the upper teeth 1010 accordingly drop to be engaged with the lower teeth 1014 and to pressurize the sheet. When thus pressurized, the sheets S are stretched, to thereby have fibers exposed from surfaces thereof, and when further pressurized, the fibers of the sheets S are entangled with each other to thereby perform fastening. In other words, when the binding processing is performed for the sheets S, the sheets S are fastened to each other by swinging the upper arm 109 and pressurizing the sheets S in engagement with each other by the upper teeth 1010 of the upper arm 109 and the lower teeth 1014 of the lower arm 1012.

In a case of performing the stapleless binding for the sheets S, the sheet processing apparatus control portion 207 for controlling an operation of the stapleless binding unit 10 first uses a sensor (not shown) to detect a cam position. Then, when the sheets S are received before the stapleless binding is performed, as illustrated in FIG. 5A, the sheet processing apparatus control portion 207 controls the rotation of the motor M so that the cam 107 is located at a bottom dead center. When the cam 107 is located at the bottom dead center, space occurs between the upper teeth 1010 and the lower teeth 1014, which allows entrance of the sheets S thereinto.

At a time of a binding operation, the motor M is rotated to cause the cam 107 to swing the upper arm 109 clockwise about the shaft 1011. Then, when the cam 107 is located in the vicinity of a top dead center as illustrated in FIG. 5B, the upper teeth 1010 of the upper arm 109 and the lower teeth 1014 of the lower arm 1012 are brought into engagement with each other. With this structure, the sheets are fastened to each other.

A bent portion 109*a* provided to the upper arm 109 bends when the cam 107 is located in the vicinity of the top dead center. Thereby the rotatable member 108 gets over the top dead center of the cam 107 when the cam 107 is further rotated. After that, the cam 107 is further rotated to reach the bottom dead center again, the sensor (not shown) detects the cam 107, to thereby cause the sheet processing apparatus control portion 207 to stop the rotation of the motor M.

Figure 7:
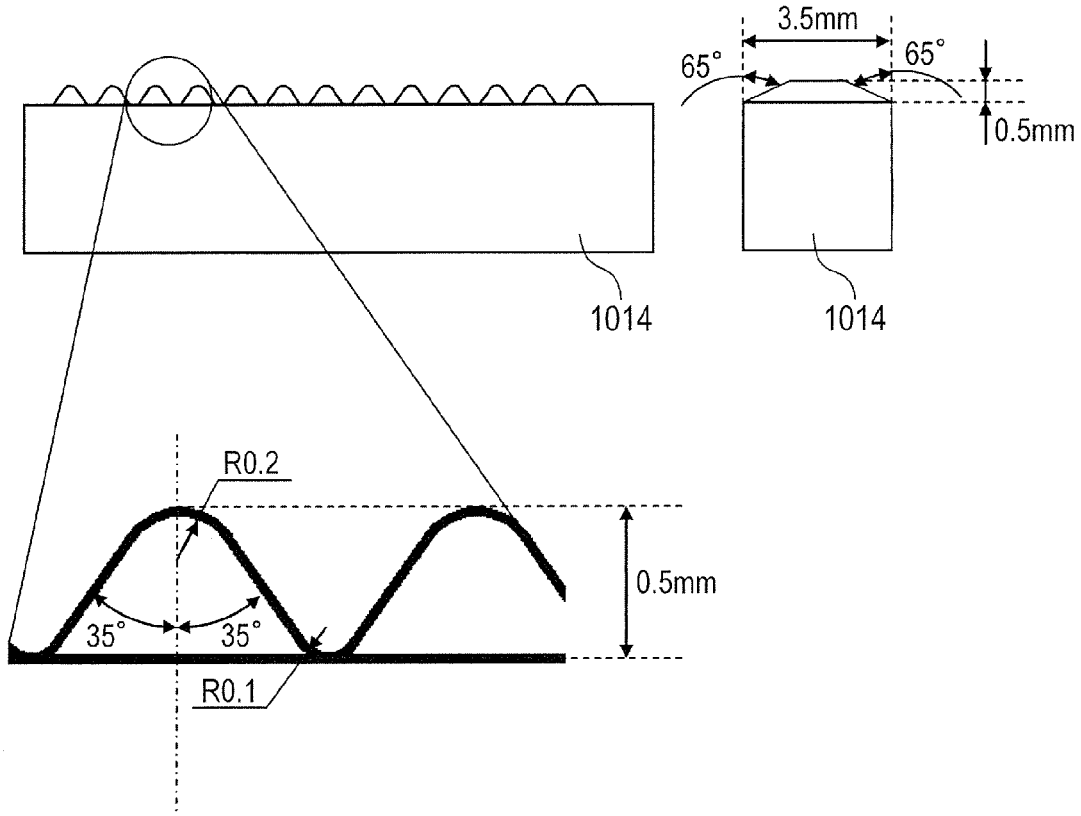
FIG. 7 is a detailed diagram of lower teeth of the above-mentioned stapleless binding unit.

FIG. 7 is an enlarged view of the lower teeth 1014 used in this embodiment. In FIG. 7, the lower teeth 1014 have an inclined angle of 35°, a tip circle radius R of 0.2 mm, a root circle radius R of 0.1 mm, a tooth height of 0.5 mm, a tooth width of 3.5 mm, a chamfer angle of 65°, and a chamfer height of 0.5 mm. The upper teeth 1010 have the same specifications as the lower teeth 1014.

Figure 8:
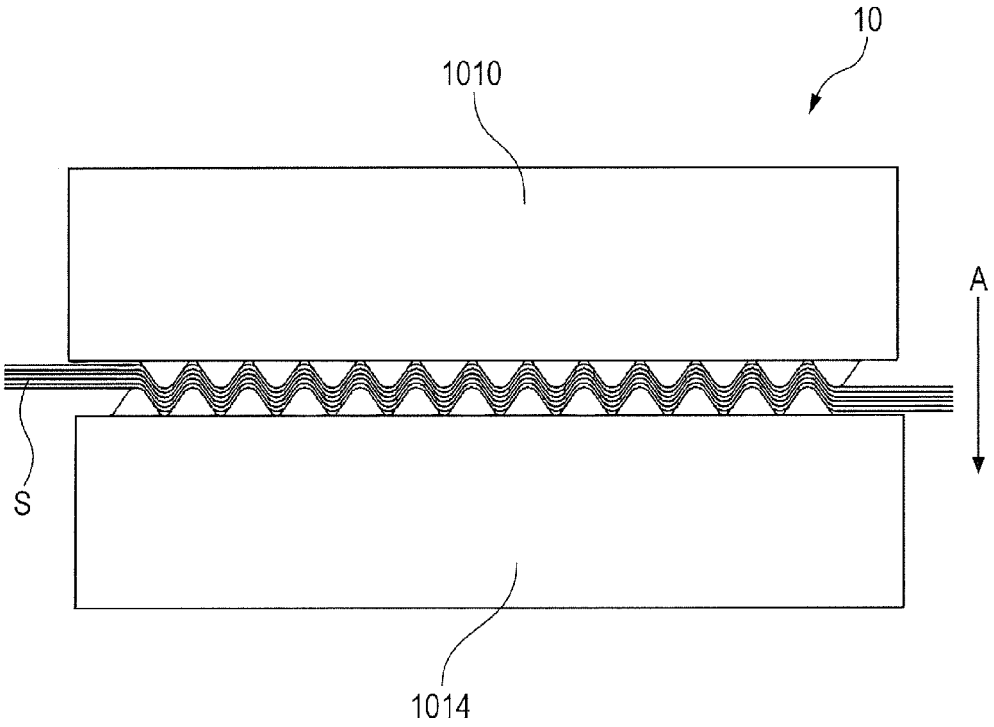
FIG. 8 is a sectional view illustrating a state of sheets subjected to stapleless binding by the above-mentioned stapleless binding unit.

FIG. 8 illustrates a state of the sheets S of a five-sheet bundle subjected to the stapleless binding by the stapleless binding unit 10. In this embodiment, a load of 6.9 kN is applied to the lower teeth 1014 from the upper teeth 1010 in a direction indicated by an arrow A with the lower teeth 1014 fixed, to thereby fasten the sheets S to each other with their fibers entangled with each other.

Figure 9:
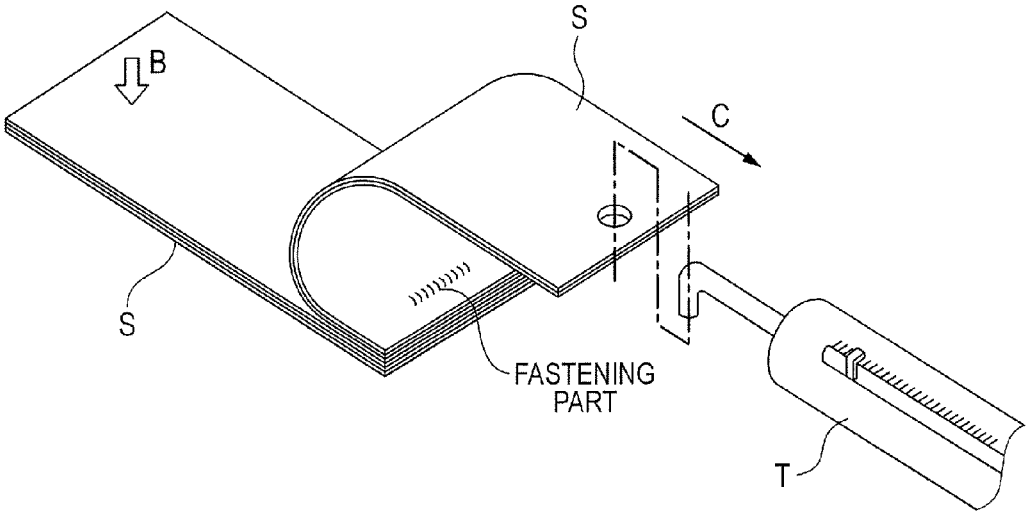
FIG. 9 illustrates a measurement method for a fastening power of the above-mentioned sheets subjected to the stapleless binding.

FIG. 9 illustrates a measurement method for a fastening power of the fastened sheets. The lower three sheets of the fastened sheets S are fixed by being held down toward a direction indicated by an arrow B, and a tension gauge T is used to pull the upper two sheets toward a direction indicated by an arrow C in which the user turns the sheets in actuality. Then, a value of the tension gauge T obtained when the fixed lower three sheets and the upper two sheets are no longer fastened and are separated from each other is set as the fastening power.

Figure 10A:
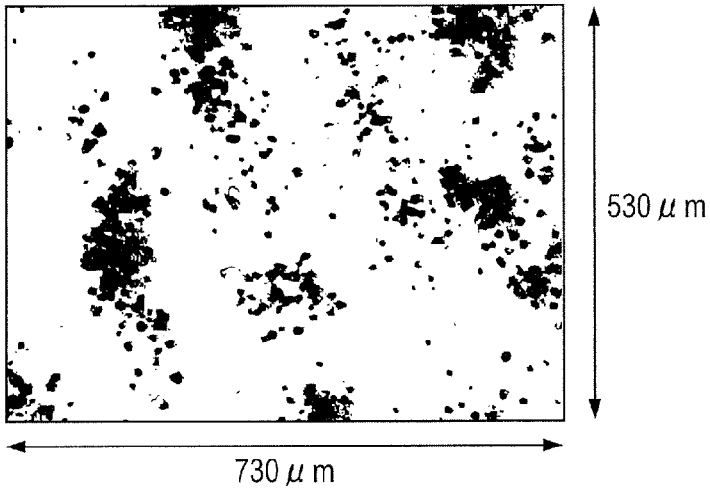
FIGS. 10A, 10B and 10C show a coverage factor of toner.
Figure 10B:
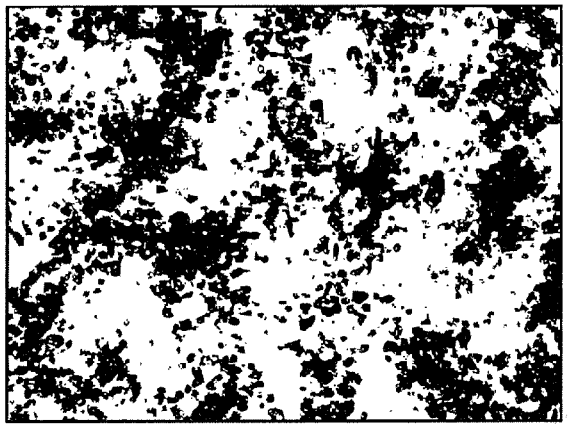
Figure 10C:
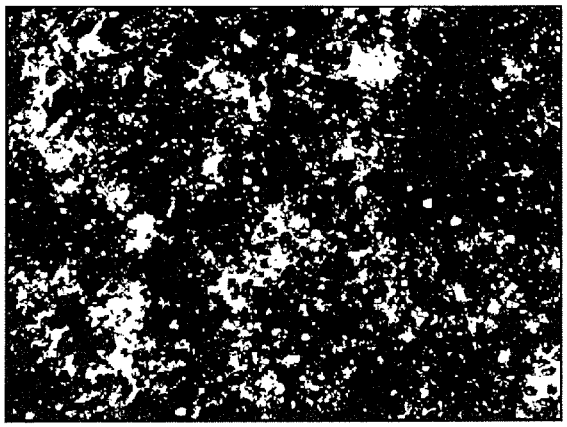

FIGS. 10A to 10C are views showing a region in which the sheet on which the image is formed by the printer 30 is fastened by the stapleless binding, the region being magnified 600 times. In FIGS. 10A to 10C, parts of the sheet covered with the toner are filled with black, and parts of the sheet having the surface exposed without the toner adhering thereto are filled with white. In such a part (530 μm high and 730 μm wide) of the region for the fastening which is magnified 600 times in the image processing, a ratio of the toner that covers the surface of the sheet is obtained. In this case, if one pixel being a minimum unit for forming the image is, for example, a square of 42 μm by 42 μm, the part illustrated in each of FIGS. 10A to 10C is assumed to be formed of approximately 200 pixels.

In the region for the fastening, a ratio of the toner that covers the surface in the part of the sheet to be subjected to the binding processing, in other words, a ratio of a region of a sheet surface covered with the toner to the region of the sheet to be subjected to the binding processing is defined as "coverage factor", and FIGS. 10A to 10C show enlarged images based on respective ratios. It is understood from FIG. 10A that the sheet surface remaining white with the fibers exposed has a larger area than a toner adhering region filled with black. The coverage factor of the toner in FIG. 10A is calculated as 8% as a result of the image processing. To be described conceptually, the 200 pixels include approximately 16 pixels filled with the toner.

It is understood from FIG. 10B that the toner adhering region filled with black covers a larger area than FIG. 10A. In the case of FIG. 10B, the coverage factor of the toner is calculated as 45%. In addition, in FIG. 10C, the toner adhering region further extends, and the coverage factor is calculated as 90% in this case. When the sheet surface that looks mottled microscopically in such a manner is viewed by human eyes, differences in the coverage factor of the toner appear as differences in density of color. In other words, the sheet surface looks dark when the coverage factor of the toner is large, and looks light when the coverage factor is small.

Figures 11A, 11B, 11C:
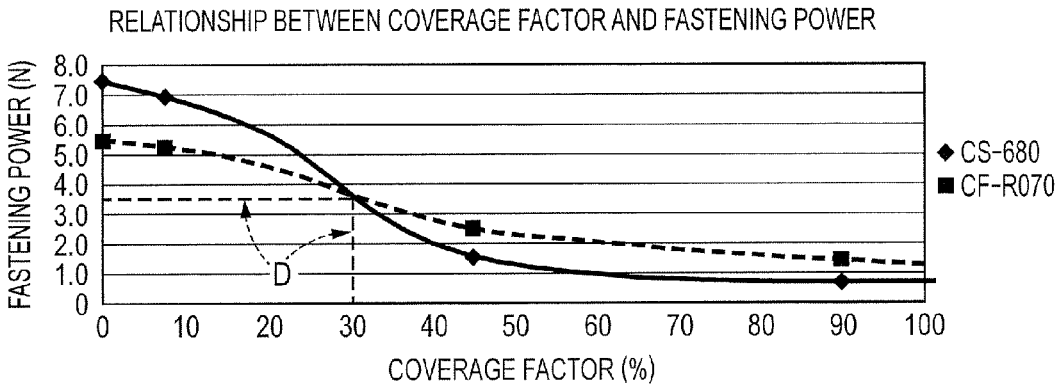
FIGS. 11A, 11B and 11C are a graph and tables showing a relationship between the above-mentioned coverage factor of toner and the fastening power of the sheets subjected to the stapleless binding.

FIG. 11A shows a relationship between the coverage factor of the toner on the sheet surface and the fastening power of the sheet in a fastening part being the part of the sheet to be subjected to the binding processing. In FIG. 11A, the vertical axis indicates the fastening power of the sheet, and the horizontal axis indicates the coverage factor of the toner. Further, values plotted in FIG. 11A are average values of the fastening power measured three times by the measurement method already described with reference to FIG. 9. In this measurement, "CS-680" (plain paper) and "GF-R070" (recycled paper) sold by Canon Marketing Japan Inc. were used as the sheets. Further, the images formed on the sheets were formed by "imageRUNNER ADVANCE C2030" which is a copier manufactured by CANON Inc.

It is understood from FIG. 11A that both CS-680 (plain paper) and GF-R070 (recycled paper) have the fastening power (N) gradually decreasing as the coverage factor (%) increases. In other words, irrespective of a difference in the fastening power depending on the kind of sheet, tendencies of the decrease in the fastening power with respect to the increase in the coverage factor are the same. A reason that the fastening power thus decreases as the coverage factor increases is because the toner adhering to the sheet surface inhibits the fibers of the sheets from being brought into contact with each other and entangled with each other. A magnitude of the inhibition correlates with a magnitude of the toner coverage factor, and as the coverage factor becomes larger, the magnitude of the inhibition increases and the fastening power decreases.

As another binding unit for binding the sheets together without using a fastener such as a wire, for example, a binding unit for binding the sheets together by opening a half-cut hole in the sheet and leaving a part to be coupled to another sheet is commercially available. When the fastening power of a sheet bundle bound by the commercially-available binding unit is measured by the same method as already described with reference to FIG. 9, an average fastening power of 3.4 N is obtained. If the average fastening power of 3.4 N is judged as a predetermined fastening power that can be accepted for general use, the fastening power above a broken line D shown in FIG. 11A is necessary in order to satisfy the fastening power.

Such experimental data that both CS-680 (plain paper) and GF-R070 (recycled paper) need to have the coverage factor of equal to or smaller than 30% in order to satisfy the fastening power in this embodiment was obtained. Conversely, the sheets having the sheet fibers exposed on 70% of the sheet surfaces or larger are pressurized by bringing the sheet surfaces into contact with each other and engaged into each other between the upper teeth 1010 and the lower teeth 1014, to thereby entangle the sheet fibers with each other, exerting the fastening power equal to or larger than a predetermined fastening power. In other words, in a case of a method of binding the sheets by entangling the fibers thereof with each other as in this embodiment, in order to attain the fastening power of 3.4 N, the toner coverage factor in the fastening part needs to be set to equal to or smaller than 30%.

Figure 12:
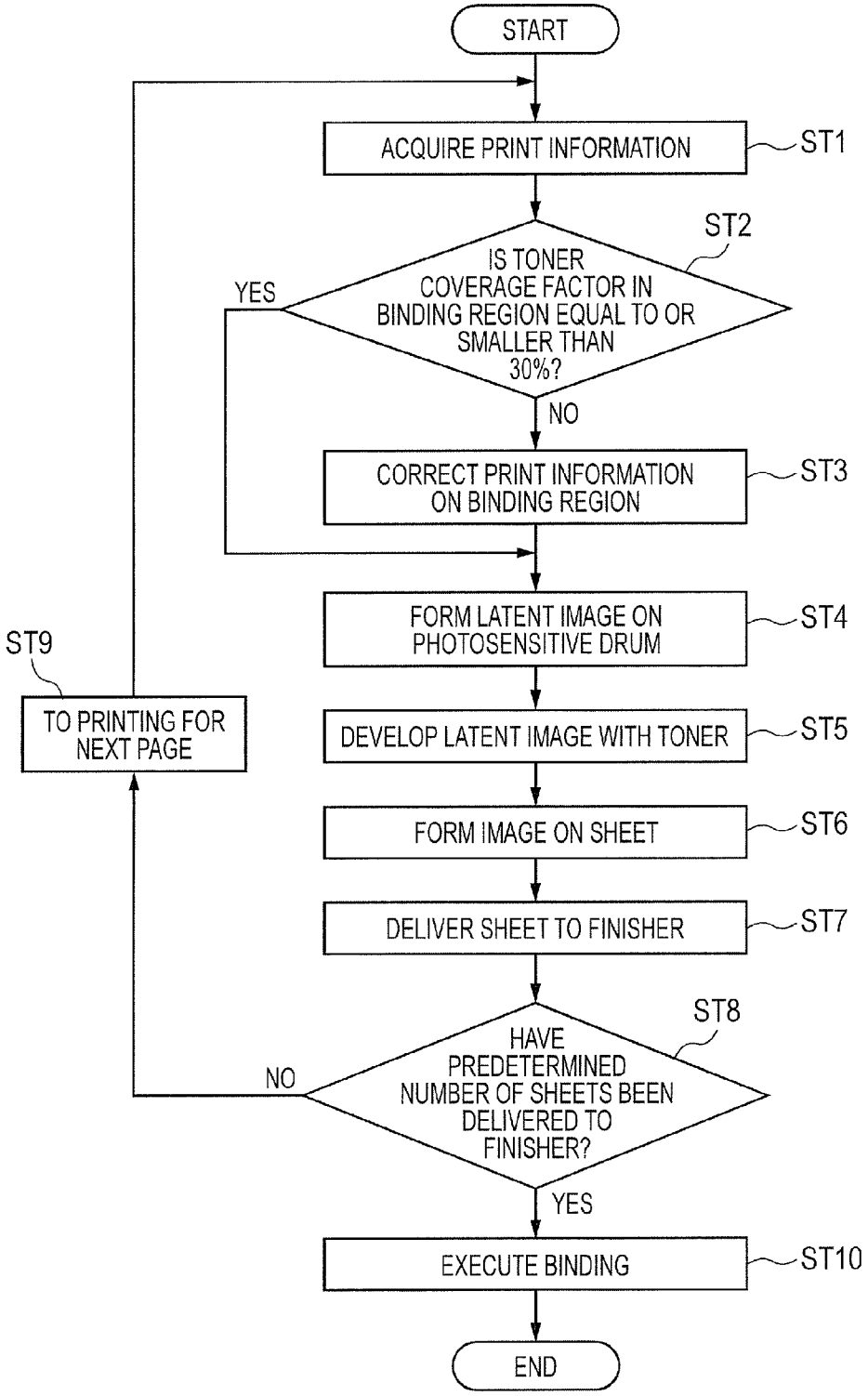
FIG. 12 is a flowchart illustrating toner coverage factor control performed in a fastening part by the above-mentioned printer main body.

In this embodiment, the image is output by being controlled so that the toner coverage factor in a part corresponding to the fastening part of the sheet output by the printer main body 31 is equal to or smaller than 30% being a predetermined value. Subsequently, such toner coverage factor control in the fastening part is described with reference to a flowchart illustrated in FIG. 12.

Figure 13A:
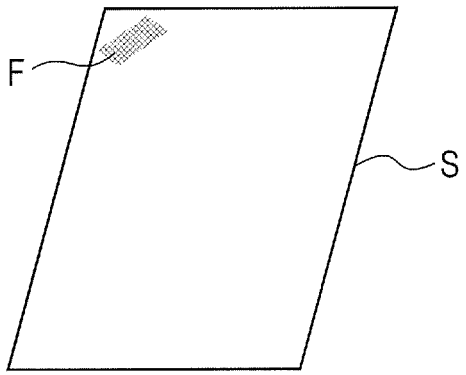
FIGS. 13A and 13B illustrate the sheet for which the above-mentioned coverage factor does not need to be corrected and the sheet of which the above-mentioned coverage factor has been corrected.

The CPU circuit portion 200 first acquires print information (image information) via the automatic original reading apparatus control portion 204 or the external I/F 208 (ST1). Subsequently, the toner coverage factor corresponding to the image density in the region of a fastening part F of the sheet S illustrated in FIG. 13A is determined by using the acquired print information via the image signal control portion 205 (ST2). When the toner coverage factor in the binding region being the region of the fastening part F of the sheet S is equal to or smaller than 30% (Y in ST2), the latent image is formed on the photosensitive drum 3 without a change (ST4).

Figure 13B:
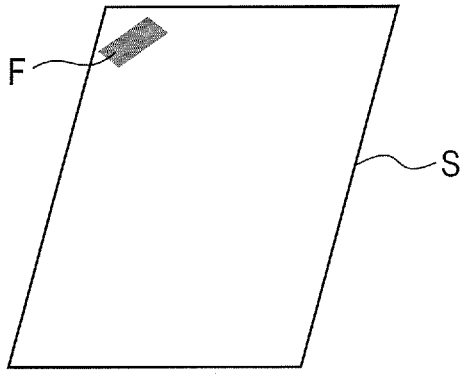

When, as illustrated in FIG. 13B, the toner coverage factor in the binding region is larger than 30% (N in ST2), the CPU circuit portion 200 being a correction portion for correcting the image data corrects the print information on the binding part so that the toner coverage factor is equal to or smaller than 30% (ST3). For example, the CPU circuit portion 200 limits the light amount of the laser light with which the photosensitive drum 3 is irradiated by the laser scanner unit 2. With this correction, the toner coverage factor in the binding region is equal to or smaller than 30% as illustrated in FIG. 13A. In the case where the toner coverage factor is reduced to equal to or smaller than 30%, the image is light in the binding region, but stapleless binding processing is performed in the binding region, which hardly affects the entire image.

After the latent image is formed on the photosensitive drum 3 (ST4), the latent image is developed with the toner by the developing device 5 (ST5), and then the toner image is transferred onto the sheet. Subsequently, the toner image is fixed to the sheet by the fixing portion 6, to thereby form the toner image on the sheet (ST6). After that, the sheet on which the image has been formed is delivered to the finisher by delivery rollers (ST7).

Subsequently, the CPU circuit portion 200 determines whether or not a predetermined number of sheets have been delivered to the finisher 1 (ST8). Then, when the predetermined number of sheets have not been delivered to the finisher 1 (N in ST8), printing is performed for the next page (ST9). When the predetermined number of sheets have been delivered to the finisher 1 (Y in ST8), the sheet processing apparatus control portion 207 is instructed to execute the binding processing, to thereby cause the sheet processing apparatus 1 to execute binding (ST10).

Figure 14:
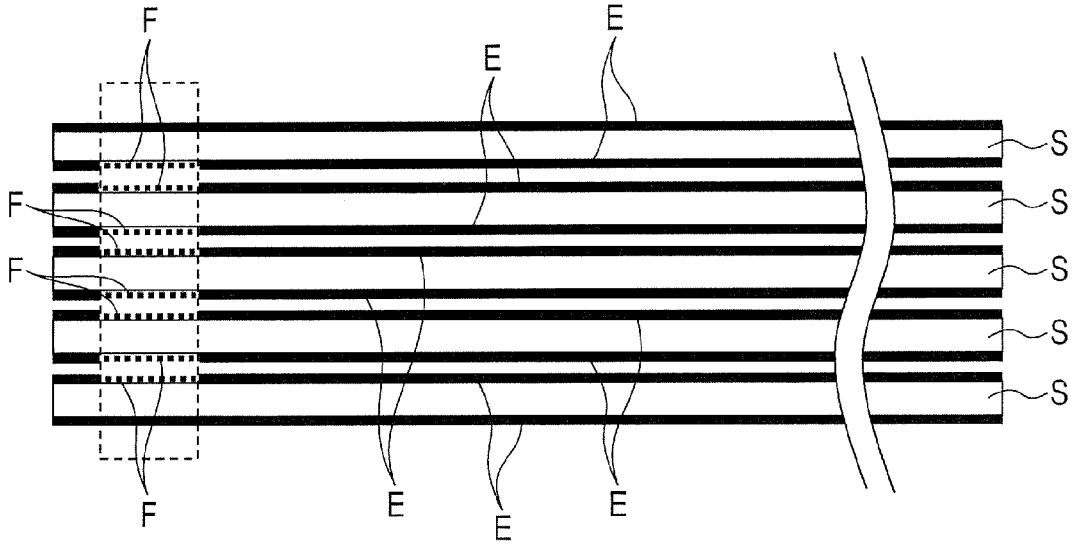
FIG. 14 is a sectional view illustrating a state in which stapleless binding processing is performed for the sheets having the coverage factor corrected to equal to or smaller than 30% by the above-mentioned stapleless binding unit.

FIG. 14 is a sectional view illustrating a state in which the binding processing is performed for the sheets S on which the image having the print information corrected to exhibit a coverage factor of equal to or smaller than 30% is formed. In FIG. 14, an E part indicates a part in which the image is formed based on the print information, and an F part indicates a part in which the image is formed based on the print information corrected to exhibit a coverage factor of equal to or smaller than 30%.

In this embodiment, as illustrated in FIG. 14, correction of the print information is performed for the surfaces of the sheets to be brought into contact with each other and to be fastened. In other words, the images for which the coverage factor is not corrected are formed on a front surface of the sheet bundle and a back surface of the sheet bundle that are not brought into contact with another sheet, in other words, a front surface and a back surface of the sheets that do not include the region to be subjected to the binding processing. In this manner, a high-quality resultant can be provided as the sheet bundle. Even when the images for which the coverage factor is corrected are formed on the front surface and the back surface of the sheet bundle, stability of the fastening power is not impaired.

As described above, as in this embodiment, by correcting the image data to set the coverage factor of the toner in the part of the sheet to be subjected to the binding processing to equal to or smaller than 30% (equal to or smaller than the predetermined value), it is possible to reliably subject fibrous sheets to the stapleless binding.

The above description is directed to the printer provided with the finisher 1 disposed between the printer main body 31 and the original reading apparatus 36, but the present invention is not limited thereto. For example, the present invention can be applied to an image forming system in which the finisher 1 including the stapleless binding unit 10 is provided to a side of the printer 30. In a case where the stapleless binding is not performed for the sheet S already subjected to the image formation and delivered from the printer main body 31, the sheet S may be directly delivered from the printer main body 31 to the processing tray 40 without passing through the finisher 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-147792, filed Jun. 29, 2012, and No. 2013-125210, filed Jun. 14, 2013, which are hereby incorporated by reference herein in their entirety.

What is claimed is:

1. An image forming apparatus, comprising:

an image forming portion which forms a toner image on a sheet based on image data;

a supporting portion supporting the sheet on which the toner image is formed by the image forming portion;

a pair of tooth-like members which perform stapleless binding to sheets respectively having a binding region by engaging the binding regions of the sheets supported on the supporting portion in between the pair of tooth-like members without using staples; and a control portion performing reduction processing to data of the image data which corresponds to the binding region so that a toner density of the binding region when performing the stapleless binding is lower than that when not performing the stapleless binding.

2. An image forming apparatus according to claim 1, wherein the control portion performs the reduction processing so that a ratio of a region of a sheet surface covered with toner within the binding region is equal to or smaller than a predetermined value.

3. An image forming apparatus according to claim 1, wherein the control portion performs the reduction processing so that a ratio of a region of a sheet surface covered with toner within the binding region is equal to or smaller than 30%.

4. An image forming apparatus according to claim 1, wherein the control portion performs the reduction processing by performing replacement processing so as to replace at least a part of the data which corresponds to the binding region with other data for not forming the toner image.

5. An image forming apparatus according to claim 4, wherein the control portion does not perform the replacement processing to the image data except the data which corresponds to the binding region.

6. An image forming apparatus according to claim 1, wherein, when performing the stapleless binding, the control portion does not perform the reduction processing to the image data except the data which corresponds to the binding region.

7. An image forming apparatus according to claim 1, wherein the pair of tooth-like members have surfaces respectively including concave and convex portions which engage the sheets in between the surfaces and pressurize to bind the sheets.

8. An image forming apparatus, comprising:

an image forming portion which forms a toner image on a sheet;

a supporting portion supporting the sheet on which the toner image is formed by the image forming portion;

a pair of tooth-like members which binds sheets respectively having a binding portion by engaging the binding portions of the sheets supported on the supporting portion in between the pair of tooth-like members; and a control portion performing replacement processing to image data which corresponds to the binding portion so as to replace at least a part of the image data with other data for not forming the toner image.

9. An image forming apparatus according to claim 8, wherein the control portion performs the replacement processing so that a ratio of a region of a sheet surface covered with toner within the binding portion is equal to or smaller than a predetermined value.

10. An image forming apparatus according to claim 8, wherein the control portion performs the replacement processing so that a ratio of a region of a sheet surface covered with toner within the binding portion is equal to or smaller than 30%.

11. An image forming apparatus according to claim 8, wherein the control portion does not perform the replacement processing when the pair of tooth-like members does not engage the binding portions.

12. An image forming apparatus according to claim 8, wherein the pair of tooth-like members have surfaces respectively including concave and convex portions which engage the sheets in between the surfaces and pressurize to bind the sheet.

13. An image forming apparatus, comprising:

an image forming portion which forms a toner image on a sheet based on image data;

a supporting portion supporting the sheet on which the toner image is formed by the image forming portion;

a pair of tooth-like members which perform stapleless binding to sheets respectively having a binding portion by engaging the binding portions of the sheets supported on the supporting portion in between the pair of tooth-like members without using staples; and a control portion performing reduction processing to data of the image data which corresponds to a specific region including the binding portion so that a toner density of the specific region when performing the stapleless binding is lower than that when not performing the stapleless binding.

14. An image forming apparatus according to claim 13, wherein the control portion performs the reduction processing to the data so that a ratio of a region of a sheet surface covered with toner within the specific region is equal to or smaller than a predetermined value.

15. An image forming apparatus according to claim 13, wherein the control portion performs the reduction processing to the data so that a ratio of a region of a sheet surface covered with toner within the specific region is equal to or smaller than 30%.

16. An image forming apparatus according to claim 13, wherein the control portion performs the reduction processing by performing replacement processing so as to replace at least a part of the data which corresponds to the specific region with other data for not forming the toner image.

17. An image forming apparatus according to claim 16, wherein the control portion does not perform the replacement processing to the image data except the data which corresponds to the specific region.

18. An image forming apparatus according to claim 13, wherein, when performing the stapleless binding, the control portion does not perform the reduction processing to the image data except the data which corresponds to the specific region.

19. An image forming apparatus according to claim 13, wherein the pair of tooth-like members have surfaces respectively including concave and convex portions which engage the sheets in between the surfaces and pressurize to bind the sheet.

20. An image forming apparatus, comprising:

an image forming portion configured to form a toner image on sheets based on image data;

a supporting portion configured to support the sheets on which the toner image is formed by the image forming portion;

a pair of tooth-like members configured to perform stapleless binding in which the pair of tooth-like members bind the sheets supported on the supporting portion by biting binding regions of the sheets; and a data processing portion configured to process image data of the binding region so that a toner density of the binding region when performing the stapleless binding becomes lower than that when not performing the stapleless binding.

21. An image forming apparatus according to claim 20, wherein the data processing portion processes the image data of the binding region so that a ratio of a region of a sheet surface covered with toner within the binding region is equal to or smaller than a predetermined value.

22. An image forming apparatus according to claim 20, wherein the data processing portion processes the image data of the binding region so that a ratio of a region of a sheet surface covered with toner within the binding region is equal to or smaller than 30%.

23. An image forming apparatus according to claim 20, wherein the data processing portion processes the image data of the binding region by performing replacement processing so as to replace at least a part of the image data of the binding region with other data for not forming the toner image.

24. An image forming apparatus according to claim 23, wherein the data processing portion does not perform the replacement processing to image data except the binding region.

25. An image forming apparatus according to claim 20, wherein, when performing the stapleless binding, the data processing portion does not process image data except the image data of the binding region.

26. An image forming apparatus according to claim 20, wherein the pair of tooth-like members have surfaces respectively including concave and convex portions which engage the sheets in between the surfaces and pressurize to bind the sheets.

27. An image forming apparatus according to claim 20, wherein the binding region is a corner portion of the sheet.

28. An image forming apparatus according to claim 1, wherein the binding region is a corner portion of the sheet.

29. An image forming apparatus according to claim 8, wherein the control portion performs the replacement processing to image data which corresponds to a specific region including the binding portion so as to replace at least a part of the image data with other data for not forming the toner image, wherein the control portion does not perform the replacement processing to image data except the image data which corresponds to the specific region.

30. An image forming apparatus according to claim 8, wherein the image forming portion forms a toner image on the sheet based on the image data on which the replacement processing has been performed by the control portion.

31. An image forming apparatus according to claim 20, wherein the image forming portion forms a toner image on the sheet based on the image data which has been processed by the data processing portion.

* * * * *